US005955252A

United States Patent [19]

Goto et al.

[11] Patent Number: 5,955,252

[45] Date of Patent: Sep. 21, 1999

[54] SILVER HALIDE PHOTOGRAPHIC MATERIAL

[75] Inventors: Takahiro Goto; Nobuaki Inoue, both of Kanagawa, Japan

[73] Assignee: Fuji Photo Film Co., Ltd., Kanagawa, Japan

[21] Appl. No.: 08/312,681

[22] Filed: Sep. 28, 1994

Related U.S. Application Data

[63] Continuation of application No. 08/037,436, Mar. 26, 1993, abandoned.

[30] Foreign Application Priority Data

Mar. 27, 1992 [JP] Japan ..... 4-070963

[51] Int. Cl.[6] ..... G03C 1/34; G03C 1/035

[52] U.S. Cl. ..... 430/567; 430/569; 430/604; 430/605; 430/615

[58] Field of Search ..... 430/567, 569, 430/604, 605, 615

[56] References Cited

U.S. PATENT DOCUMENTS

| | | | |
|---|---|---|---|
| 4,933,272 | 6/1990 | McDugle et al. | 430/567 |
| 4,939,067 | 7/1990 | Takagi et al. | 430/615 |
| 4,956,263 | 9/1990 | Ishigaki et al. | 430/615 |
| 5,070,008 | 12/1991 | Maekawa et al. | 430/605 |
| 5,260,183 | 11/1993 | Ishiguro et al. | 430/615 |
| 5,283,169 | 2/1994 | Goto | 430/615 |

FOREIGN PATENT DOCUMENTS 0336427 10/1989 European Pat. Off. .

0369486 5/1990 European Pat. Off. .

*Primary Examiner*—Mark F. Huff

*Attorney, Agent, or Firm*—Sughrue, Mion, Zinn, Macpeak & Seas, PLLC

[57] ABSTRACT

A silver halide photographic material comprising a support having thereon at least one silver halide emulsion layer containing silver halide grains having a silver chloride content of at least 70 mol % and containing a transition metal selected from the group consisting of elements belonging to Groups V to VIII of the Periodic Table in an amount of at least $1\times10^{-7}$ mol per mol of silver, the silver halide grains being formed in the presence of a compound represented by following formula (I);

(I)

wherein $R^1$, $R^2$, $R^3$, and $R^4$, which may be the same or different, each represents a hydrogen atom, an alkyl group, an aryl group, an amino group, a hydroxy group, an alkoxy group, an alkylthio group, a carbamoyl group, a halogen atom, a cyano group, a carboxy group, an alkoxycarbonyl group, or a heterocyclic residue; and $R^1$ and $R^2$ or $R^2$ and $R^3$ may combine with each other and form a 5-membered or 6-membered ring; and with the proviso that at least one of $R^1$ and $R^2$, however, represents a hydroxy group.

7 Claims, No Drawings

SILVER HALIDE PHOTOGRAPHIC MATERIAL

This is a Continuation of Application Ser. No. 08/037, 436, filed Mar. 26, 1993 now abandoned.

FIELD OF THE INVENTION

The present invention relates to a silver halide photographic material, and in particular, to a silver halide photographic material useful in a photomechanical process. More specifically, the invention relates to a silver halide photographic material capable of being handled under circumstances capable of being substantially called a light room.

BACKGROUND OF THE INVENTION

In the field of the duplication of prints, the improvement in the working efficiency of the photomechanical process has been desired in order to meet the variety of and the complexity of printed materials.

In the step of montaging and film-contacting works improvement in the working efficiency has been made by carrying out the work under more light circumstance. For the purpose, the development of a silver halide photographic material for plate making capable of being handled under what could be considered to be a substantially light room and the development of an exposure printer have proceeded.

The silver halide photographic material for a light room as used in the description of the present invention means a silver halide photographic material which can be used under light of wavelengths of at least 400 n.m. not including ultraviolet components as safe-light.

The silver halide photographic material for light room being used for montaging and film-contacting works is a photographic material which is utilized to achieve a negative image/positive image transformation or a positive/negative image transformation. This transformation is achieved by contact exposure of the silver halide photographic material for duplication using a developed photographic film having formed thereon characters or dot images as an original. This original must have;

(1) a performance that a dot image, a line image, and a character image are subjected to negative image/positive image transformation in conformity with the dot area, the line width, and the character image width, respectively and (2) a performance that the tone of a dot image and the line width of a character image and a line image can be controlled.

Silver halide photographic materials for contact in a light room capable of meeting these requirements have been proposed.

However, a conventional silver halide photographic material for contact in a light room has the disadvantage that in the control of dot images in a duplication step in a light room using the light-sensitive material for a light room, the exposure turns out to be an under exposure and the density of a portion which ought to be wholly developed and blackened tends to be greatly reduced.

It is known that if the silver halide grains are made finer the density can be recovered. However, in the case of using silver halide grains mainly composed of silver chloride, since the solubility of the silver halide grains is high, the grains are formed by reducing the temperature at grain formation or increasing the addition speed of a halide solution and a silver salt solution to reduce the sizes of the silver halide grains formed. However, there is a problem that during the grain formation and after the grain formation, physical ripening proceeds and in particular, the grain sizes become large during desalting.

Also, when silver halide grain formation is carried out at a low temperature of 30° C. or less, it is difficult to control the temperature at a constant value for production convenience. Hence, a method of stably producing the silver halide grains at such a low temperature has been desired.

Furthermore, when fine silver chloride grains are used, there is a problem that uneven processing tends to occur on photographic processing of the silver halide photographic material. In particular, the occurrence of uneven squeezing of the rollers (physical developed stains) in the developing portion of an automatic processor is a serious problem.

Also, in each of a lithographic development, a RAS development which is widely useful and simple controllable development with no specific development advantage, and a hybrid development which uses amine compound as an accelerator and shows super high contrast photographic properties due to development advantage, a silver halide photographic material stably providing a high toe contrast and high Dmax in a stable manner has been desired.

SUMMARY OF THE INVENTION

A first object of the present invention is to provide a silver halide photographic material having a high covering power.

A second object of the present invention is to provide a silver halide photographic material showing stable photographic properties without any photographic processing unevenness.

A third object of the present invention is to provide a silver halide photographic material of a universal type without the need of selecting a specific developer.

It has now been discovered that these objects are attained by the present invention described hereinbelow.

That is, the present invention provides a silver halide photographic material comprising a support having thereon at least one silver halide emulsion layer containing silver halide grains having a silver chloride content of at least 70 mol % and containing a transition metal selected from the group consisting of elements belonging to Groups V to VIII of the Periodic Table in an amount of at least $1\times10^{-7}$ mol per mol of silver, with the silver halide grains being formed in the presence of a compound represented by following formula (I);

(I)

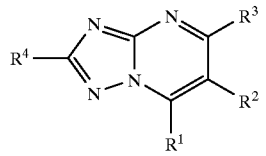

wherein $R^1$, $R^2$, $R^3$, and $R^4$, which may be the same or different, each represents a hydrogen atom, an alkyl group, an aryl group, an amino group, a hydroxy group, an alkoxy group, an alkylthio group, a carbamoyl group, a halogen atom, a cyano group, a carboxy group, an alkoxycarbonyl group, or a heterocyclic group; $R^1$ and $R^2$ or $R^2$ and $R^3$ may combine with each other and form a 5-membered or 6-membered ring; with the proviso that at least one of $R^1$ and $R^3$, represents a hydroxy group.

DETAILED DESCRIPTION OF THE INVENTION

The silver halide for the silver halide emulsion used in the present invention is silver chlorobromide or silver chloroiodobromide composed of at least 70 mol % silver chloride. As the amount of silver bromide or silver iodide is increased, the safelight stability of the silver halide photographic material containing such a silver halide emulsion in light room becomes poorer, a high silver chloride emulsion is preferred in the present invention.

The compounds of the formula (I) which can be used in the present invention are explained in detail below.

In formula (I), $R^1$, $R^2$, $R^3$, and $R^4$, which may be the same or different, each represents a hydrogen atom; a substituted or unsubstituted alkyl group having from 1 to 20 carbon atoms, which may be straight chain, branched chain or cyclic; a monocyclic or bicyclic substituted or unsubstituted aryl group; a substituted or unsubstituted amino group; a hydroxy group; an alkoxy group having from 1 to 20 carbon atoms; an alkylthio group having from 1 to 6 carbon atoms; a carbamoyl group which may be substituted by an aliphatic group or an aromatic group; a halogen atom; a cyano group; a carboxy group; an alkoxycarbonyl group having from 2 to 20 carbon atoms; or a 5-membered or 6-membered heterocyclic residue having one or more of a nitrogen atom, an oxygen atom, and a sulfur atom as hetero atoms.

Moreover, $R^1$ and $R^2$ or $R^2$ and $R^3$ may combine with each other to form a 5-membered or 6-membered ring but with the proviso that at least one of $R^1$ and $R^3$, however, represents a hydroxy group.

Examples of the suitable unsubstituted alkyl groups are methyl, ethyl, n-propyl, i-propyl, n-butyl, t-butyl, hexyl, cyclohexyl, cyclopentylmethyl, octyl, dodecyl, tridecyl, and heptadecyl groups.

Examples of substituents of the above-described substituted alkyl groups are a monocyclic or bicyclic aryl group, a heterocyclic group, a halogen atom, a carboxy group, an alkoxycarbonyl group having from 2 to 6 carbon atoms, an alkoxy group having from 1 to 20 carbon atoms, and a hydroxy group.

Specific examples of suitable substituted alkyl groups are benzyl, phenethyl, chloromethyl, 2-chloroethyl, trifluoromethyl, carboxymethyl, 2-carboxyethyl, 2-(methoxycarbonyl)ethyl, ethoxycarbonylmethyl, 2-methoxyethyl, hydroxymethyl, and 2-hyddroxyethyl.

Examples of appropriate unsubstituted aryl groups are phenyl and naphthyl. Examples of suitable substituents of the substituted aryl groups are an alkyl group having from 1 to 4 carbon atoms, a halogen atom, a nitro group, a carboxy group, an alkoxycarbonyl group having from 2 to 6 carbon atoms, a hydroxy group, and an alkoxy group having from 1 to 6 carbon atoms. Specific examples of substituted aryl groups are p-tolyl, m-tolyl, p-chlorophenyl, p-bromophenyl, o-chlorophenyl, m-nitrophenyl, p-carboxyphenyl, o-carboxyphenyl, o-(methoxycarbonyl)phenyl, p-hydroxyphenyl, p-methoxyphenyl, and m-ethoxyphenyl.

The amino group represented by each of $R^1$, $R^2$, $R^3$, and $R^4$ may be substituted and examples of suitable substituents are an alkyl group (e.g., methyl, ethyl, and butyl) and an acyl group (e.g., acetyl and methylsulfonyl). Specific examples of substituted amino groups are dimethylamino, diethylamino, butylamino, and acetylamino.

Specific examples of alkoxy groups represented by each of $R^1$, $R^2$, $R^3$, and $R^4$ are methoxy, ethoxy, butoxy, and heptadecyloxy.

The carbamoyl group represented by each of $R^1$, $R^2$, $R^3$, and $R^4$ may have one or two substituents such as an alkyl group having from 1 to 20 carbon atoms and a monocyclic or bicyclic aryl group. Specific examples of substituted carbamoyl groups are methylcarbamoyl, dimethylcarbamoyl, ethylcarbamoyl, and phenylcarbamoyl.

Specific examples of alkoxycarbonyl groups represented by each of $R^1$, $R^2$, $R^3$, and $R^4$ are methoxycarbonyl, ethoxycarbonyl, and butoxycarbonyl.

Specific examples of the halogen atoms represented by each of $R^1$, $R^2$, $R^3$, and $R^4$ are fluorine, chlorine, and bromine.

The heterocyclic ring represented by each of $R^1$, $R^2$, $R^3$, and $R^4$ may be a monocyclic residue or may have a condensed ring of 2 or 3 rings and specific examples of suitable heterocyclic ring are furyl, pyridyl, 2-(3-methyl) benzothiazolyl, and 1-benzotriazolyl.

Examples of rings formed by $R^1$ and $R^2$ or $R^2$ and $R^3$ are a cyclopentane ring, a cyclohexane ring, a cyclohexene ring, a benzene ring, a furan ring, a pyrrolidine ring, and a thiophene ring.

When $R^4$ represents a substituted alkyl group, the substituent may be a heterocyclic ring and the substituted alkyl group shown by following formula is preferred as the above-described substituted alkyl group.

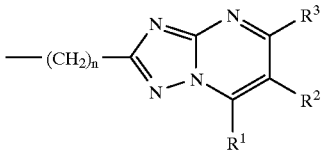

wherein $R^1$, $R^2$, and $R^3$ each have the same meaning as described above and n represents 2 or 4.

Specific examples of compounds represented by formula (I) are illustrated below but the invention is not to be construed as being limited to these compounds.

1

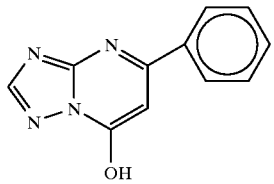

2

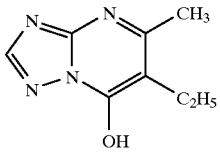

3

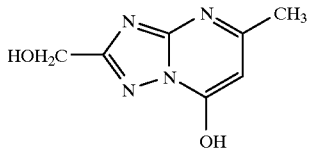

-continued
4
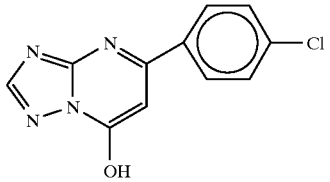
5
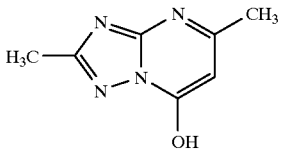
6
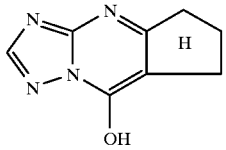
7
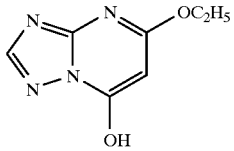
8
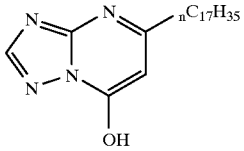
9
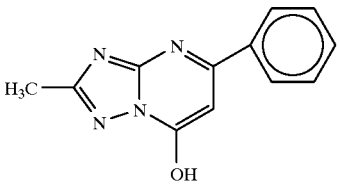
10
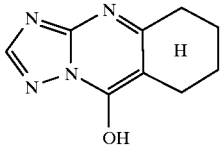
11
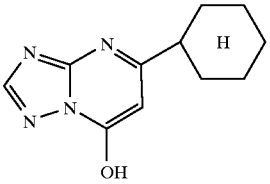
-continued
12
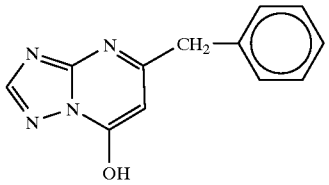
13
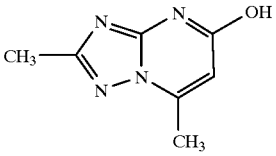
14
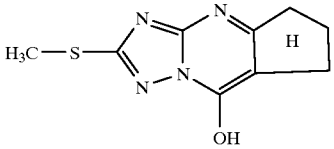
15
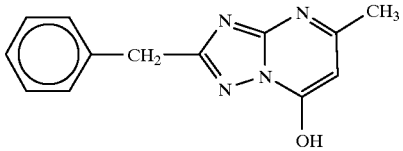
16
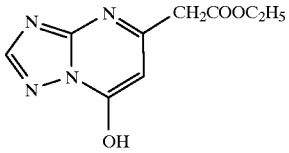
17
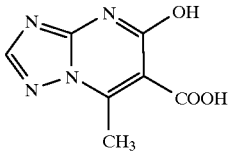
18
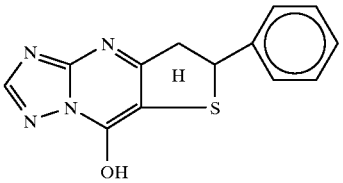
19
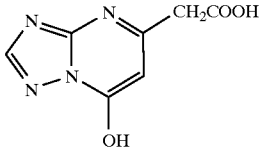
20
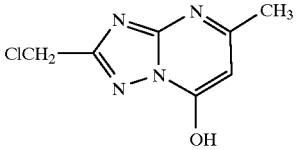

-continued

21

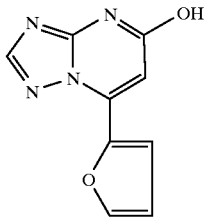

22

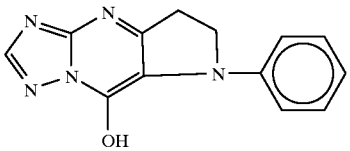

23

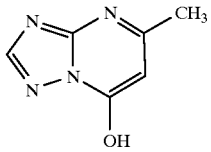

24

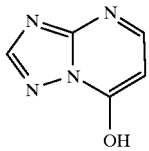

The compounds represented by formula (I) are added before the formation of the silver halide grains and may be previously added to an aqueous gelatin solution for producing the silver halide emulsion which is used in the present invention.

The amount of the compound of formula (I) used is preferably from $5\times10^{-4}$ mol to $5\times10^{-2}$ mol, and particularly preferably from $1\times10^{-3}$ mol to $1\times10^{-2}$ mol, per mol of silver.

The grain sizes of the silver halide grains in the silver halide emulsion which is used in the present invention are preferably 0.20 $\mu$m or less. Since fine silver halide grains mainly composed of silver chloride have a high solubility, physical ripening of the silver halide grains proceeds in any stage during the formation or after the formation of the silver halide grains, for example, before, during or after adding silver compound and halide compound, or before rinsing. Accordingly, the compound of formula (I) is added thereto before the formation of the silver halide grains as described above.

Also, the compounds of formula (I), when used in the amount described above, do not adversely influence the photographic performance of the silver halide photographic material in photographic processing. Rather, the addition of the compound of formula (I) causes the advantage that the dissolution of the silver halide grains in a developer is prevented and the physical developed stain, which caused by uneven physical development, does not occur at processing. Also, the fine silver halide grains can be formed without need of a temperature reduction at the formation of the silver halide grains and hence a fine grain silver halide emulsion can be produced in a stable manner.

In the present invention, when the silver halide grains are prepared under mixing conditions such that the reaction temperature is 50° C. or less and the Ag potential is at least 70 mV, and preferably from 80 mV to 120 mV, under sufficiently highly stirring conditions for uniformly mixing the added components, a good result can be obtained.

There is fundamentally no restriction on the grain size distribution of the grains used in the present invention but monodisperse silver halide grains are preferred.

In this case, the term "monodisperse" means that at least 95% by weight or by grain number of the silver halide grains are composed of silver halide grains having grain sizes within ±40%, and more preferably ±20%, of the mean grain size.

The silver halide emulsion which is used in the present invention is produced by the copresence of a transition metal hexa-coordination complex represented by the following formula in the step of formation or physical ripening of the silver halide grains.

$$[M(NY)_mL_{6-m}]^n$$

wherein M represents a transition metal selected from the group consisting of elements belonging to Groups V to VIII of the Periodic Table; L represents a cross-linked ligand; Y represents oxygen or sulfur; m represents 0, 1, or 2; and n represents 0, −1, −2, or −3.

Preferred examples of crosslinked ligands represented by L are a halide ligand (e.g., a fluoride, a chloride, a bromide, and an iodide), a cyanide ligand, a cyanate ligand, a thiocyanate ligand, a selenocyanate ligand, a tellurocyanate ligand, an acid ligand, and an aquo ligand. When an aquo ligand is present, it is preferred for the ligand to occupy 1 or 2 ligand positions.

Preferred examples of transition metals represented by M are rhodium, ruthenium, rhenium, osmium, and iridium.

Then, specific examples of transition metal coordination complexes are shown below.

1. $[Rh(H_2O)Cl_5]^{-2}$
2. $[RuCl_6]^{-3}$
3. $[Ru(NO)Cl_5]^{-2}$
4. $[RhCl_6]^{-3}$
5. $[Ru(H_2O)Cl_5]^{-2}$
6. $[Ru(NO)(H_2O)Cl_4]^{-1}$
7. $[Re(NO)Cl_5]^{-2}$
8. $[Os(NO)Cl_5]^{-2}$
9. $[Ir(NO)Cl_5]^{-2}$
10. $[Ir(H_2O)Cl_5]^{-2}$
11. $[Re(H_2O)Cl_5]^{-2}$
12. $[RhBr_6]^{-2}$
13. $[Os(NS)Cl(SCN)_4]^{-2}$
14. $[RhCl_6]^{-3}$
15. $[InCl_6]^{-3}$
16. $[Re(BS)Cl_4(SeCN)]^{-2}$

The foregoing metal complex can be added to the silver halide grains during the preparation of the silver halide grains to incorporate the metal complex into the grains.

The amount of the transition metal in the silver halide grains used in the present invention is at least $1\times10^{-7}$ mol, preferably from $1\times10^{-6}$ to $5\times10^{-4}$ mol, and particularly preferably from $5\times10^{-6}$ to $2\times10^{-4}$ mol per mole of silver halide.

Also, the foregoing transition metals may be used alone or as a combination thereof.

There is no particular restriction on the distribution of the transition metal in the silver halide grains but it is preferred for the transition metal to be present in the surface portion to a greater extent than in the inside portion.

The hydrophilic colloid layer or the silver halide emulsion layer of the silver halide photographic material of the present invention may contain a water-soluble dye or a solid form-dispersed dye as a filter dye or for other purposes such as irradiation prevention, etc. Oxonol dyes, hemioxonol dyes, styryl dyes, merocyanine dyes, cyanine dyes, and azo dyes can be used as such a dye. Of these dyes, oxonol dyes, hemioxonol dyes, and merocyanine dyes are advantageous.

The silver halide photographic emulsion(s) and light insensitive hydrophilic colloid(s) used the present invention may contain an inorganic or organic hardening agent.

Examples of suitable hardening agents which can be used for the silver halide photographic material of the present invention are active vinyl compounds {e.g., 1,3,5-triacryloyl-hexahydro-s-triazine, bis(vinylsulfonyl) methyl ether, and N,N-methylenebis-[β-(vinylsulfonyl) propionamido]}, active halogen compounds (e.g., 2,4-dichloro-6-hydroxy-s-triazine), mucohalic acids (e.g., mucochloric acid), N-carbamoylpyridinium salts (e.g., (1-morphol)carbonyl-3-pyridinio)methane sulfonate), and haloamidinium salts (1-(1-chloro-1-pyridino-methylene) pyrrolidinium, and 2-naphthalene sulfonate). These hardening agents can be used alone or as a combination thereof if desired.

Of these compounds, the active vinyl compounds described in JP-A-53-41220, JP-A-53-57257, JP-A-59-162546, and JP-A-60-80846 (the term "JP-A" as used herein means an "unexamined published Japanese patent application") and the active halides described in U.S. Pat. No. 3,325,287 are preferred.

The silver halide photographic emulsion layer(s) and other hydrophilic colloid layer(s) of the silver halide photographic material of the present invention may further contain various kinds of surface active agents for various purposes, e.g., as a coating acid, for static prevention, for slidability improvement, for emulsion-dispersion, for sticking prevention and improvements in photographic characteristics (e.g., development acceleration, increase of contrast, and increase of sensitivity).

Examples of surface active agent which can be used in the present invention are nonionic surface active agents such as saponin (steroid series), alkylene oxide derivatives (e.g., polyethylene glycol, a polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and polyethylene oxide addition products of silicone), glycidol derivatives (e.g., alkenylsuccinic acid polyglyceride and alkylphenol polyglyceride), aliphatic acid esters of a polyhydric alcohol, and alkyl esters of saccharose; anionic surface active agents containing an acidic group such as a carboxylate group, a sulfonate group, a phosphonate group, a sulfuric acid ester group, a phosphoric acid ester group, etc., for example, alkyl carboxylates, alkyl sulfonates, alkylbenzene sulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, and polyoxyethylene-alkylphosphoric acid esters; amphoteric surface active agents such as aminoacids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic or aromatic quaternary ammonium salts, heterocyclic quaternary ammonium salts (e.g., pyridinium and imidazolium), phosphonium or sulfonium salts containing an aliphatic group or a heterocyclic ring.

Also, for the static prevention, the fluorine series surface active agents described in JP-A-60-80849 can be advantageously used.

Furthermore, the silver halide photographic emulsion layer(s) and other hydrophilic colloid layer(s) of the silver halide photographic material of the present invention can further contain a matting agent such as silica, magnesium oxide, polymethyl methacrylate, etc., for the purpose of adhesion prevention.

The silver halide photographic material used in the present invention can further contain a dispersion of a water-insoluble or water sparingly soluble synthetic polymer for the purpose of dimensional stability. For example, alkyl (meth)acrylates, alkoxyacryl (meth)acrylates, glycidyl (meth)acrylates, etc., can be used alone or as a combination thereof or polymers of a combination of the foregoing (meth)acrylate and acrylic acid, methacrylic acid, etc., as the monomer components can be used.

Gelatin can be advantageously used as a condensing agent or a protective colloid for the silver halide photographic emulsion being used in this invention, but other synthetic colloids can be used. For example, proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; saccharose derivatives such as sodium alginate, starch derivatives, etc.; and various kinds of synthetic hydrophilic polymers such as popovinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc., can be used.

In addition to lime-treated gelatin, acid-treated gelatin may be used as the gelatin and also a gelatin hydrolyzed product and a gelatin enzyme-decomposed product can be used.

The silver halide photographic emulsion layer(s) used in the present invention can contain a polymer latex such as an alkyl acrylate latex.

Suitable supports for the silver halide photographic material of the present invention include a cellulose triacetate film, a cellulose diacetate film, a nitrocellulose film, a polystyrene film, a polyethylene terephthalate film, a baryta-coated paper, a polyolefin-coated paper, etc.

There is no particular restriction on the developing agent used for the developer which is used to develop the silver halide photographic material of the present invention. However, from the standpoint of easily obtaining good dot quality, dihydroxybenzenes are preferably used. Also, a combination of a dihydroxybenzene and a 1-phenyl-3-pyrazolidone or a combination of a dihydroxybenzene and a p-aminophenol can be used as desired.

Examples of dihydroxybenzene developing agents which can be used in the present invention are, for example, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, but hydroquinone is particularly preferred.

Examples of 1-phenyl-3-pyrazolidone or derivatives thereof which can be used as a developing agent in the present invention are, for example, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Also, the p-aminophenol series developing agent used in the present invention can be for example, N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Of these compounds, N-methyl-p-aminophenol is preferred.

It is preferred for the developing agent to be used in an amount of from 0.05 mol/liter to 0.8 mol/liter. Also, when a combination of a dihydroxybenzene and a 1-phenyl-3-pyrazolidone or p-aminophenol is used, it is preferred that the former is used in an amount of from 0.05 mol/liter to 0.5 mol/liter and the latter is used in an amount of not more than 0.06 mol/liter.

In the present invention, a sulfite is used as a preservative for the developer. Examples of preservatives are sodium sulfite, potassium sulfite, lithium sulfite, ammonium sulfite, sodium hydrogensulfite, potassium metahydrogensulfite, formaldehyde sodium hydrogensulfite, etc.

The sulfite is used in an amount of preferably at least 0.3 mol/liter, and more preferably at least 0.4 mol/liter. The upper limit of the sulfite is preferably 2.5 mols/liter, and more preferably 1.2 mol/liter.

Examples of alkali agents for controlling the pH of the developer used in the present invention include pH controlling agents and buffers, such as sodium hydroxide, potassium hydroxide, sodium carbonate, potassium carbonate, sodium tertiary phosphate, potassium tertiary phosphate, sodium silicate, potassium silicate, etc.

The developer for use in the present invention may further contain various additives in addition to the foregoing components. Examples of appropriate additives are development inhibitors such as boric acid, borax, sodium bromide, potassium bromide, potassium iodide, etc.; organic solvents such as ethylene glycol, diethylene glycol, triethylene glycol, dimethyl formamide, Methyl Cellosolve, hexylene glycol, ethanol, methanol, etc.; and antifoggants such as mercapto compounds (e.g., 1-phenyl-5-mercaptotetrazole and sodium 2-mercaptobenzimidazole-5-sulfonate), indazole compounds (e.g., 5-nitroindozole), benztriazole compounds (e.g., 5-methylbenztriazole), etc.

Furthermore, if desired the developer may further contain a toning agent, a surface active agent, a defoaming agent, a water softener, a hardening agent, etc. In particular, the use of the amino compounds described in JP-A-56-106244 or the imidazole compounds described in JP-B-48-35493 (the term "JP-B" as used herein means an "examined published Japanese patent application") is preferred from the standpoint of development acceleration or the increase in sensitivity.

However, in the present invention, a stable performance is obtained in using the hybrid developer containing an amine, an RAS developer, and a lithographic developer. From the standpoints of cost, environmental problems, and processing stability, a combination with an RAS developer is most preferable.

The developer for use in the present invention can further contain the compounds described in JP-A-56-24347 as a silver stain inhibitor, the compounds described in JP-A-62-212651 as an uneven development inhibitor, and the compounds described in JP-A-61-267759 as a dissolution aid.

Furthermore, boric acid described in JP-A-62-186259, saccharides (e.g., saccharose) described in JP-A- 60-93433, oximes (e.g., acetoxime), phenols (e.g., 5-sulfosalicyclic acid), tertiary phosphates (e.g., sodium tertiary phosphate and potassium tertiary phosphate), etc., can be used as a buffer in the developer used in the present invention. Of these materials, boric acid is preferably used.

After development, the silver halide photographic material of the present invention is fixed with a fix solution. The fix solution is an aqueous solution containing a fixing solution and, if desired, a hardening agent (e.g., a water-soluble aluminum compound), acetic acid, and a dibasic acid (e.g., tartaric acid, citric acid or the salts thereof). The pH of the fix solution is preferably at least 3.8, and more preferably from 4.0 to 5.5.

Examples of fixing agents include sodium thiosulfate, ammonium thiosulfate, etc., and ammonium thiosulfate is particularly preferred from the standpoint of fixing speed. The amount of the fixing agent can be appropriately varied but is generally from about 0.1 to about 5 mols/liter.

The water-soluble aluminum compound acting mainly as a hardening agent in the fix solution is a compound generally known as a hardening agent for an acidic hardening fix solution and examples thereof are aluminum chloride, aluminum sulfate, and potassium alum.

Examples of the foregoing dibasic acid used as the fixing agent for the fix solution include tartaric acid, derivatives thereof, citric acid, and derivatives thereof. These compounds can be used alone or as a mixture thereof. The compound is incorporated in the fix solution in an amount of preferably at least 0.005 mol/liter, and particularly preferably from 0.01 mol/liter to 0.03 mol/liter.

Specific examples of appropriate dibasic acids are tartaric acid, potassium tartarate, sodium tartarate, sodium potassium tartrate, ammonium tartrate, and potassium ammonium tartrate.

In the present invention, citric acid or the derivatives can also be used as the hardening agent and examples of effective derivatives are sodium citrate and potassium citrate.

The fix solution for use in the present invention can further contain, if desired, a preservative (e.g., sulfites and hydrogensulfites), a pH buffer (e.g., acetic acid and boric acid), a pH controlling agent (e.g., ammonia and sulfuric acid), an image storage stability improving agent (e.g., potassium iodide), and a chelating agent. In this case, the pH buffer is used in an amount of from about 10 to 40 g/liter, and preferably from 18 to 25 g/liter since the pH of the developer is high.

The fixing temperature and time are same as that for development, and are preferably at a temperature of from about 20° C. to about 50° C. for from 10 seconds to 1 minute.

After fixing, the silver halide photographic material of the present invention is washed with water. In this case, the wash water may contain an antifungal agent (e.g., the compounds described in Hiroshi Horiguchi, *Bokin Bobai no Kagaku* (*Antibacterial and Antifungal Chemistry*), JP-A-62-115154, etc.), a washing accelerator (e.g., sulfites), a chelating agent, etc.

According to the above-described process, the silver halide photographic material thus developed and fixed is washed with water and dried. Water washing is carried out by substantially completely removing the silver salts dissolved by fixing and is preferably carried out at a temperature of from about 20° C. to about 50° C. for from 10 seconds to 3 minutes. Drying is carried out at a temperature of from about 40° C. to about 100° C. The drying time can be appropriately changed according to the surroundings but it is usually from about 5 seconds to 3 minutes and 3 seconds.

A roller transport type automatic developing machine is described in U.S. Pat. Nos. 3,025,779 and 3,545,971 and such can be used with this invention. This processor is referred to as "a roller transporting type processor" hereinafter for simplicity.

A roller transport type processor achieves the four steps of development, fixing, washing, and drying. The process for processing the silver halide photographic material of the present invention does not exclude other steps (e.g., a stop step) but is most preferably composed of these four steps. In this case, by employing a counter current washing system of two or three stages for the water washing step, the amount of water used can be saved.

It is preferred for the developer used in the present invention to be stored using a packaging material having a low oxygen permeability as described in JP-A-61-73147. Also, for the developer used in the present invention, the replenishing system described in JP-A-62-91939 can be advantageously used.

Since the silver halide photographic material of the present invention gives a high Dmax, when the light-sensitive material is subjected to a reducing process after forming images, a high density is maintained although the dot areas are reduced.

There is no particular restrictions on the reducer used in the present invention and the reducers described, e.g., in Meas, *The Theory of the Photographic Process,* pp. 738–744 (Macmillan, 1954), Tetsuo Yano, *Shashin Shori to sono Riron to Jissai* (*Photographic Processing and the Theory and Practice*), pp. 166–169 (Kyoritsu Shuppan, 1954), JP-A-50-27543, JP-A-52-68429, JP-A-55-17123, JP-A-55-79444, JP-A-57-10140, JP-A-57-142639, and JP-A-61-61155 can be used.

That is, a reducer containing a permanganate, a persulfate, a ferric salt, a cupric salt, a selenic salt, potassium ferricyanide, a bichromate, etc., alone or as a mixture thereof as an oxidizing agent and, if desired, an inorganic acid such as sulfuric acid, etc., and an alcohol or a reducer containing an oxidizing agent such as potassium ferricyanide, ethylenediaminetetraacetic acid ferric salt, etc., a silver halide solvent such as a thiosulfate, a rhodanide, a thiourea, or derivatives of them, and, if desired, an inorganic acid such as sulfuric acid can be used.

Specific examples of reducer which can be used in the present invent-ion are the so-called Farmer's reducer, an ethylenediaminetetraacetic acid ferric salt reducer, a potassium permanganate reducer, an ammonium persulfate reducer, and a selenic salt reducer.

Preferred conditions for reducing processing are for the process to be conducted at a temperature of from 10° C. to 40° C., and particularly from 15° C. to 30° C. for from several seconds to several tens minutes, and in particular within a few minutes. By using the light-sensitive material for plate making of the present invention, a sufficiently wide reduced width can be obtained within the foregoing conditions.

The reducer functions on the silver image formed in the silver halide emulsion layer through the nonsensitive upper layer containing the compound of formula (I) for use in this invention.

The reducing processing can be applied to the silver images using conventional techniques. For example, a method of immersing the light-sensitive material for plate making in the reducer followed by stirring or a method of applying the reduce on the surface of the light-sensitive material for plate making with a brush, a roller, etc., can be utilized.

The invention is described more specifically by reference to the following examples but the invention is not to be construed as being limited to these examples. Unless otherwise indicated herein, all parts, percents ratios and the like are by weight.

EXAMPLE 1

Preparation of Silver Halide Emulsions

To an aqueous gelatin solution kept at a temperature of 40° C. were simultaneously added an aqueous silver nitrate solution and an aqueous sodium chloride solution containing $(NH_4)_2Rh(H_2O)Cl_5$ in an amount of $4\times10^{-5}$ per mol of silver over a period of 3.5 minutes and one minute later, an aqueous silver nitrate solution and an aqueous sodium chloride solution containing $(NH_4)_2Rh(H_2\mathbf{0})Cl_5$ in an amount of $1.2\times10^{-4}$ mol per mol of silver were simultaneously added to the mixture over a period of 7 minutes to provide a silver chloride emulsion containing silver chloride grains. Then, the silver halide emulsion was desalted by flocculation using a formaldehyde condensation product of naphthalenesulfonic acid in a conventional manner.

A summary of the procedures and characteristics of each silver halide emulsion thus formed, such as the addition time and the addition amount of each of the compounds represented by formula (I), the temperature of the formation of the silver halide grains, etc., are shown in Table 1 below.

TABLE 1

| Em. | Grain Forming Temp. (°C.) | Compound No. of Formula (I) | Addition Time | Addition Amount (mol/Ag mol) | Mean Grain Size (μm) |
|---|---|---|---|---|---|
| A | 40 | — | — | — | 0.16 |
| B | " | Comparison Compound 1 | Before Grain Formation | $5\times10^{-3}$ | 0.10 |
| C | " | Comparison Compound 2 | " | " | 0.10 |
| D | " | Compound 23 | " | " | 0.12 |
| E | " | Compound 23 | " | $1\times10^{-2}$ | 0.10 |
| F | " | Compound 6 | " | $5\times10^{-3}$ | 0.10 |
| G | " | Compound 6 | After Grain Formation | " | 0.14 |
| H | 45 | — | — | — | 0.20 |
| I | " | Compound 6 | After Grain Formation | $5\times10^{-3}$ | 0.14 |
| J | | Compound 24 | " | $1\times10^{-2}$ | 0.15 |
| K | " | Comparison Compound 3 | " | $5\times10^{-3}$ | 0.14 |

Em.: Emulsion
Emulsions D, E, F, I and J are emulsions of the invention and other emulsions are comparison emulsions.
Comparison Compound 1:1-Phenyl-5-mercaptotetrazole
Comparison Compound 2:5-Methylbenzotriazole
Comparison Compound 3:2-Mercaptobenzimidazole

Preparation of Coated Samples

To each of the silver halide emulsions described above were added 24 mg/m$^2$ of 5,6-cyclopentane-4-hydroxy-1,3,3a,7-tetraazaindene, 770 mg/m$^2$ of an ethyl acrylate latex (mean particle size 0.05 μm), 3 mg/m$^2$ of the compound of the following formula

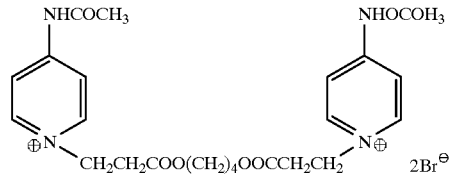

and 126 mg/m$^2$ of 2-bis(vinylsulfonylacetamido)ethane as a hardening agent and the resultant mixture was coated on a polyester support at a silver coverage (coated amount) of 3.0 g/m$^2$. The gelatin coverage was 1.5 g/m$^2$.

On the emulsion layer was coated a lower protective layer composed of 0.8 g/m$^2$ of gelatin, 8 mg/m$^2$ of α-lipoic acid, 6 mg/m$^2$ of $C_2H_5SO_2SNa$, and 230 mg/m$^2$ of an ethyl acrylate latex (mean particle size 0.05 μm) and further on the protective layer was coated an upper protective layer composed of 0.7 g/m$^2$ of gelatin and 40 mg/m$^2$ of the following dye in a solid dispersed state. In this case, 55 mg/m$^2$ of a matting agent (silicon dioxide, mean particle size 3.5 μm), 135 mg/m$^2$ of Snowtex C (produced by Nissan Chemicals Industries and having mean particle size 0.02 μm), 25 mg/m$^2$ of sodium dodecylbenzenesulfonate as a coating aid, 20 mg/m$^2$ of the sodium salt of the sulfuric acid ester of polyoxyethylene nonylphenyl ether (polymerization degree 5), and 3 mg/m$^2$ of N-perfluorooctanesulfonyl-N-propylglycine potassium salt were simultaneously coated thereon to provide each sample.

In addition, the support used in the example had a back layer and a back protective layer each having the following composition. (The swelling ratio of the back layers was 110%.)

Back Layer

| | |
|---|---|
| Gelatin | 170 mg/m$^2$ |
| Sodium Dodecylbenzenesulfonate | 32 mg/m$^2$ |
| Dihexyl-α-sulfosuccinate sodium | 35 mg/m$^2$ |
| $SnO_2$/Sb (9/1 by weight ratio, mean particle size 0.25 μm) | 318 mg/m$^2$ |

Back Protective Layer

| | |
|---|---|
| Gelatin | 2.7 g |
| Silicon Dioxide Matting Agent (mean particle size 3.5 μm) | 26 mg/m$^2$ |
| Dihexyl-α-sulfosuccinate Sodium | 20 mg/m$^2$ |
| Sodium Dodecylbenzenesulfonate | 67 mg/m$^2$ |
| $C_8F_{17}SO_2-N(C_3H_7)-(CH_2CH_2O)_n-(CH_2)_4-SO_3Li$ | 5 mg/m$^2$ |

Dye A

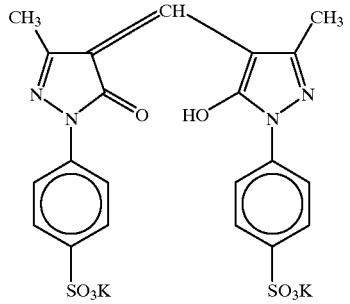

190 mg/m$^2$

Dye B

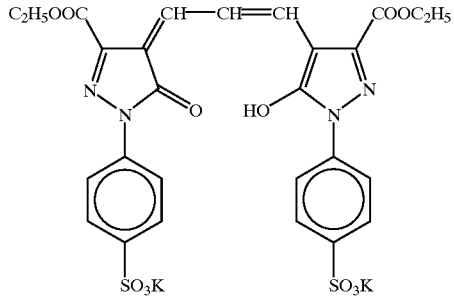

32 mg/m$^2$

Dye C

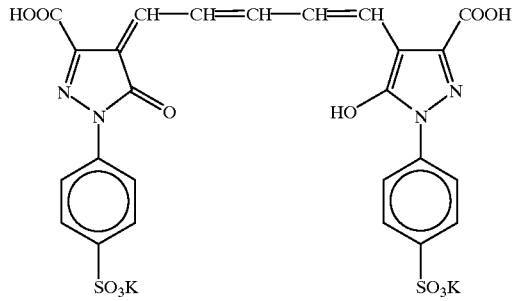

59 mg/m$^2$

| | |
|---|---|
| Ethyl Acrylate Latex (mean particle size 0.05 μm) | 260 mg/m$^2$ |
| 1,3-Divinylsulfonyl-2-propanol | 149 mg/m$^2$ |

Photographic Performance

Each of the samples thus obtained was exposed through an optical wedge using a P-627 FM Printer (mercury) (manufactured by Dainippon Screen Mfg., Co., Ltd.), developed using a developer, LD-835 (trade name, made by Fuji Photo Film Co., Ltd.) at 38° C. for 20 seconds using an automatic processor, FG800RA (manufactured by Fuji Photo Film Co., Ltd.), fixed, washed, and dried.

The following characteristics of each of the samples were evaluated.

1) Sensitivity

The logarithm of the reciprocal of the exposure amount providing a density of 0.1, wite the sensitivity of Sample No. 1 being defined as 100 and the sensitivity of the other samples is shown as a relative value.

2) Dmax, Dmax(−1%)

An adhered support on which a film having formed a dot image (dot image original) was fixed using an adhesive tape was closely disposed on each film sample in a face-to-face relation of the protective layer of the sample and the dot image original and the maximum blackened densities on exposing the film sample such that a dot area of 50% became dot areas 50% and 49% were defined as Dmax and Dmax (−1%), respectively.

3) Gradation $$1.5-0.1/[\log(A)-\log(B)]$$

A: Exposure amount providing a density of 0.1

B: Exposure amount providing a density of 1.5

4) Physical Developed Stain

When each unexposed sample was tray-developed using the foregoing developer, LD-835 at 38° C. for 20 seconds and immersed in a fix solution, the state of the occurrence of unevenness was visually functionally evaluated and is represented by ○, Δ, and ×, wherein Δ is the lower limit of the level where no practical problems occur.

The results obtained are shown in Table 2 below.

TABLE 2

| Sample No. | Emulsion | Photographic Characteristic: Sensitivity | Dmax | Dmax (−1%) | Gradation | Physical Developed Stain |
|---|---|---|---|---|---|---|
| 1 | A | 100 | 4.2 | 3.7 | 5.5 | X |
| 2 | B | 70 | 3.5 | 3.5 | 4.1 | ○ |
| 3 | C | 72 | 3.4 | 2.9 | 4.1 | ○ |
| 4 | D | 96 | 5.5 | 5.2 | 8.5 | ○ |
| 5 | E | 94 | 5.6 | 5.3 | 8.7 | ○ |
| 6 | F | 94 | 5.6 | 5.3 | 9.1 | ○ |
| 7 | G | 96 | 5.2 | 4.9 | 7.2 | ○ |

TABLE 2-continued

| Sample No. | Emulsion | Photographic Characteristic: Sensitivity | Dmax | Dmax (−1%) | Gradation | Physical Developed Stain |
|---|---|---|---|---|---|---|
| 8 | H | 120 | 3.8 | 3.2 | 5.0 | Δ |
| 9 | I | 108 | 5.3 | 5.0 | 8.2 | ○ |
| 10 | J | 107 | 5.3 | 5.0 | 8.2 | ○ |
| 11 | K | 108 | 3.0 | 2.5. | 3.8 | ○ |

As is clear from the results shown in Table 2, it can be seen that the samples of the present invention are silver halide photographic materials where no physical developed stains occur, which have high Dmax, and which have a high toe gradation.

EXAMPLE 2

The development proceeding characteristics of each of Samples No. 1 to No. 6 in Example 1 were evaluated using a developer, GR-Dl (trade name, made by Fuji Photo film Co., Ltd.). The evaluated characteristics were sensitivity, Dmax, and gradation.

The results obtained are shown in Table 3 below.

TABLE 3

| Sample No. | Emulsion | Photographic Characteristics (38° C.): Sensitivity 10" | Sensitivity 15" | Sensitivity 20" | Dmax 10" | Dmax 15" | Dmax 20" | Gradation 10" | Gradation 15" | Gradation 20" |
|---|---|---|---|---|---|---|---|---|---|---|
| 1 | A | 80 | 90 | 100 | 3.2 | 3.7 | 4.2 | 4.2 | 4.9 | 5.5 |
| 2 | B | 60 | 65 | 70 | 3.0 | 3.2 | 3.5 | 3.6 | 3.9 | 4.1 |
| 3 | C | 62 | 67 | 72 | 2.9 | 3.1 | 3.4 | 3.6 | 3.9 | 4.1 |
| 4 | D | 95 | 96 | 96 | 5.0 | 5.4 | 5.5 | 7.9 | 8.2 | 8.5 |
| 5 | E | 93 | 94 | 94 | 5.2 | 5.4 | 5.6 | 8.2 | 8.5 | 8.7 |
| 6 | F | 93 | 94 | 94 | 5.3 | 5.5 | 5.6 | 8.5 | 8.9 | 9.1 |

Sample Nos. 4 to 6 are sample of this invention and the other samples are comparison samples.

As is clear from the results shown in Table 3 above, the development proceeds quickly in the samples of the present invention, and a stable performance is obtained with super quick processing.

As described above, according to the present invention, a silver halide photographic material having a high toe gradation, high Dmax, with no physical developed stains occurring, and suitable for duplication step (contact work) in a light room is provided and also a fine grain silver halide emulsion having a production stability is achieved.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer containing silver halide grains having a silver chloride content of at least 70 mol % and containing a transition metal selected from the group consisting of elements belonging to Groups V to VIII of the Periodic Table in an amount of at least $1\times10^{-7}$ mol per mol of silver, the silver halide grains having a grain size of 0.20 $\mu$m or smaller and being formed in the presence of a compound represented by the following formula (I);

(I)

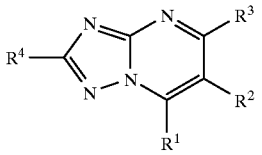

wherein $R^4$ is selected from the croup consisting of a hydrogen atom, an alkyl group, an aryl group, an amino group, a hydroxy group, an alkoxy group, an alkylthio group, a carbamoyl group, a halogen atom, a cyano group, a carboxy group, an alkoxycarbonyl group, and a heterocyclic residue; $R^2$ and $R^3$ combine with each other and form a 5-membered or 6-membered ring; and $R^1$ represents a hydroxy group.

2. The silver halide photographic material of claim 1, wherein $R^4$ represents a hydrogen atom; a straight chain, branched chain or cyclic substituted or unsubstituted alkyl group having from 1 to 20 carbon atoms; a monocyclic or bicyclic substituted or unsubstituted aryl group; a substituted or unsubstituted amino group; a hydroxy group; an alkoxy group having from 1 to 20 carbon atoms; an alkylthio group having from 1 to 6 carbon atoms; a carbamoyl group which may be substituted by an aliphatic group or an aromatic group; a halogen atom; a cyano group; a carboxy group; an alkoxycarbonyl group having from 2 to 20 carbon atoms; or a 5-membered or 6-membered heterocyclic ring having one or more of a nitrogen atom, an oxygen atom and a sulfur atom.

3. The silver halide photographic material of claim 1, wherein the compound of the formula (I) is present in an amount of $5\times10^{-4}$ mol to $5\times10^{-2}$ mol per mol of silver.

4. The silver halide photographic material of claim 1, wherein the transition metal is present in the form of a transition metal complex.

5. The silver halide photographic material of claim 4, wherein the transition metal complex is represented by the formula $$[M(NY)_mL_{6-m}]^n$$

wherein M represents a transition metal selected from the group consisting of elements of Groups V to VIII of the Periodic Table; L represents a cross-linked ligand; Y represents oxygen or sulfur; m represents 0, 1 or 2; and n represents 0, −1, −2, or −3.

6. The silver halide photographic material of claim 5, wherein L is selected from the group consisting of a halide ligand, a cyanide ligand, a cyanate ligand, a thiocyanate ligand, a selenocyanate ligand, a tellurocyanate ligand, an acid ligand, and an aquo ligand.

7. The silver halide photographic material of claim 1, wherein said transition metal is selected from the group consisting of rhodium, ruthenium, rhenium, osmium and iridium.

* * * * *